US009719204B1

(12) United States Patent
Sequeira

(10) Patent No.: US 9,719,204 B1
(45) Date of Patent: Aug. 1, 2017

(54) DIAPER SPRAYER ATTACHABLE FLOW DIRECTOR AND SPLASH BACK GUARD

(71) Applicant: Aisha Z. Sequeira, Plano, TX (US)

(72) Inventor: Aisha Z. Sequeira, Plano, TX (US)

(73) Assignee: Aisha Z. Sequeria, Plano, TX (US)

( * ) Notice: Subject to any disclaimer, the term of this patent is extended or adjusted under 35 U.S.C. 154(b) by 218 days.

(21) Appl. No.: 14/663,139

(22) Filed: Mar. 19, 2015

Related U.S. Application Data

(60) Provisional application No. 61/970,979, filed on Mar. 27, 2014.

(51) Int. Cl.
*E03D 9/00* (2006.01)
*D06F 41/00* (2006.01)
*A47K 17/02* (2006.01)

(52) U.S. Cl.
CPC ..... *D06F 41/00* (2013.01); *A47K 17/02* (2013.01)

(58) Field of Classification Search
USPC ..... 4/300.2, 300.3, 666; 604/332; 239/106, 239/105, 288.5
See application file for complete search history.

(56) References Cited

U.S. PATENT DOCUMENTS 5,503,633 A * 4/1996 Saunders ..... A61F 5/44 4/340

* cited by examiner

*Primary Examiner* — Lauren Crane
(74) *Attorney, Agent, or Firm* — Williams Intellectual Property; Benjamin F. Williams

(57) ABSTRACT

A diaper sprayer flow director and splash back guard including an impermeable, conical splash back guard having an open base and a truncated apex attachable to a diaper sprayer head, wherein water forcibly ejected from the diaper sprayer head is directable within the splash back guard to contact a target surface or object positioned proximal or in contact with the open base, whereby splash back effected during cleaning said target is contained interior to the splash back guard and contamination of surrounding and proximal objects and surfaces is avoidable.

15 Claims, 3 Drawing Sheets

DIAPER SPRAYER ATTACHABLE FLOW DIRECTOR AND SPLASH BACK GUARD

CROSS-REFERENCE TO RELATED APPLICATIONS

This nonprovisional application claims the benefit of provisional application No. 61/970,979 filed on Mar. 27, 2014

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of diaper sprayers are known in the prior art, connectable to a toilet waterline to effect cleaning of soiled diapers interior to the toilet bowl, whereby waste fluids are drained into the toilet for flushing into the sewer system and contamination of washing surfaces in the home is avoided. However, use of a diaper sprayer necessarily ejects water under pressure to forcibly unseat material targeted upon an object or surface, to effect displacement of said material into the toilet bowl for subsequent disposal. Thus splash back, as water is ricocheted off the target surface or object during washing, can contaminate proximal objects and surfaces with fecal matter, including the person operating the diaper sprayer. This requires additional cleaning of objects and surfaces proximal the toilet, and can lead to cross-contamination resulting from the interaction of the person operating the diaper sprayer with additional objects, such as, for example, door handles, drawers, taps, and so on.

What is needed is a diaper sprayer flow director and splash back guard that includes an impermeable, conical splash back guard securable to a diaper sprayer head, whereby water flow forcible from the diaper sprayer head is containable within the splash back guard and directable to a target surface or object, whereby splash back from said target surface or object is mitigated interior to the splash back guard and contamination of proximal surfaces and objects, including the person operating the diaper sprayer, is obviated.

FIELD OF THE INVENTION

The present invention relates to a diaper sprayer flow director and splash back guard, and more particularly, to a diaper sprayer flow director and splash back guard including an impermeable, conical splash back guard having an open base and a truncated apex attachable to a diaper sprayer head, wherein water forcibly ejected from the diaper sprayer head is directable within the splash back guard to contact a target surface or object positioned proximal or in contact with the open base, whereby splash back effected during cleaning said target is contained interior to the splash back guard and contamination of surrounding and proximal objects and surfaces is avoidable.

SUMMARY OF THE INVENTION

The general purpose of the diaper sprayer flow director and splash back guard, described subsequently in greater detail, is to provide a diaper sprayer flow director and splash back guard which has many novel features that result in a diaper sprayer flow director and splash back guard which is not anticipated, rendered obvious, suggested, or even implied by prior art, either alone or in combination thereof.

The present diaper sprayer flow director and splash back guard has been devised to control water flow ejected from a diaper sprayer head while washing soiled diapers, for example, or other objects, as case may be, whereby flow is directable interior to a conical splash back guard and thereby maintained within the bounds of said splash back guard, whereby splash back from contact with a soiled diaper while washing is contained and contamination from splattering fecal matter is avoidable.

The present diaper sprayer flow director and splash back guard, therefore, includes a hollow, impermeable, conical splash back guard securable to a diaper sprayer head. The splash back guard includes an open base, positional contacting or most proximal to a target surface or object (such as a soiled diaper, for example), and a truncated apex, dispositional in contact with a diaper sprayer head. The diameter of the splash back guard is at a minimum at the truncated apex, and at a maximum at the open base. Thus, water ejected from the diaper sprayer head is containable within the splash back guard and directable towards the target for contact therewith at the open base.

Attachment to the diaper sprayer head is effective by action of an attachment member disposed radially projected in a transverse plain at the truncated apex. The attachment member includes a first ovoid portion, a second ovoid portion disposed distended from the first ovoid portion, a T-shaped connector, and a tab member. The T-shaped connector is disposed laterally projected from one side of the first ovoid portion, said first ovoid portion disposed congruent with the truncated apex. The second ovoid portion is disposed distended from an opposite side of the first ovoid portion relative the T-shaped connector. The second ovoid portion is contemplated to be pliable and elastomeric for engagement around a diaper sprayer head, whereby a tab member, disposed laterally projected from the second ovoid portion in position farthest removed from the first ovoid portion, is positional to engage with a crossbar disposed endwise on the T-shaped connector. The attachment member is thereby moveable between an attached situation, wherein a crossbar of the T-shaped connector is securable through the elongate aperture disposed in the tab member and the second ovoid portion is elastically engaged around a diaper sprayer head, and a released situation, wherein the T-shaped connector is unconnected with the tab member.

The splash back guard is thereby securable to a diaper sprayer head to position said diaper sprayer head for forcible ejection of water interior to the splash back guard whereby water flow is contained interior to said splash back guard and thereby directable over a target surface (such as a soiled diaper, for example) and splash back therefrom is containable.

It is contemplated as part of this invention that the splash back guard is polymeric. In an example embodiment herein disclosed, the splash back guard is silicone and alternately thermoplastic polyrurethane, thereby impermeable, thermoset, washable, and steamable, whereby said splash back guard is readily sterilized subsequent use. The splash back guard may also be collapsible to position each of a first, second, and third annular portion inset to the open base whereby the splash back guard is storable in a compacted situation when not in use.

Thus has been broadly outlined the more important features of the present diaper sprayer flow director and splash back guard so that the detailed description thereof that follows may be better understood and in order that the present contribution to the art may be better appreciated.

Objects of the present diaper sprayer flow director and splash back guard, along with various novel features that characterize the invention are particularly pointed out in the claims forming a part of this disclosure. For better understanding of the diaper sprayer flow director and splash back guard, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
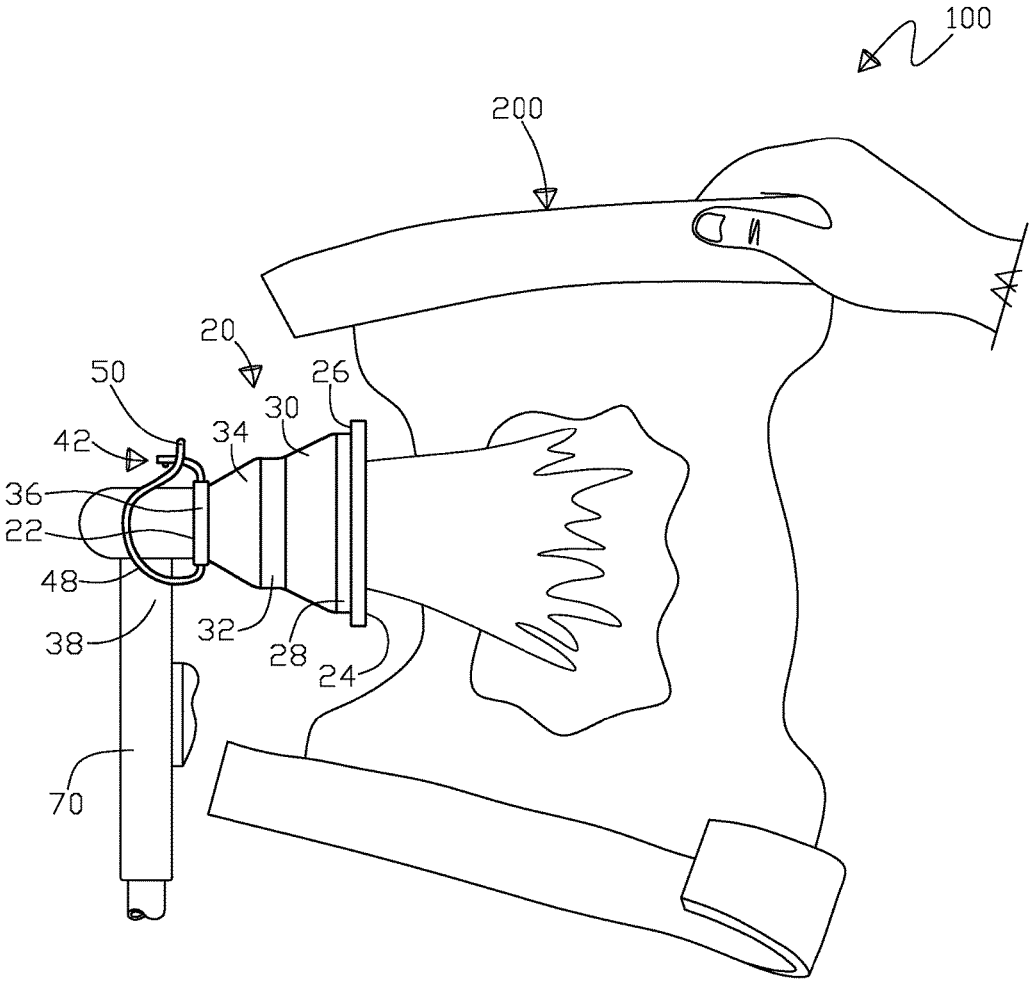
FIG. 1 is a side view, in-use, of an example embodiment secured to a diaper sprayer head.
Figure 2:
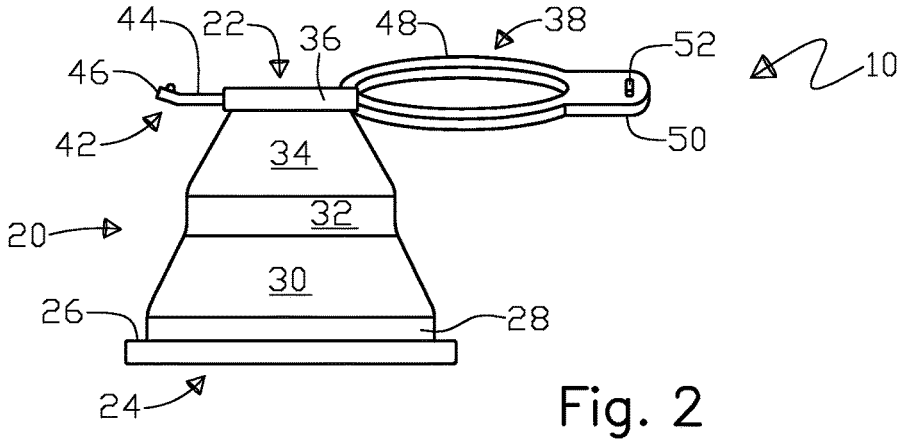
FIG. 2 is a side view of an example embodiment.

With reference now to the drawings, and in particular FIGS. 1 through 5 thereof, example of the instant diaper sprayer flow director and splash back guard employing the principles and concepts of the present diaper sprayer flow director and splash back guard and generally designated by the reference number 10 will be described.

Referring to FIGS. 1 through 5 a preferred embodiment of the present diaper sprayer flow director and splash back guard 10 is illustrated.

The present diaper sprayer flow director and splash back guard 10 has been devised to enable attachment of an impermeable, conical splash back guard 20 to a diaper sprayer head 70, disposed plumbed to a toilet 102 waterline 100, wherein water flow generable while spray cleaning soiled diapers 200 is controllable and contamination from splash back onto surrounding proximal surfaces and objects (including the user) is preventable.

The present diaper sprayer flow director and splash back guard 10, therefore, includes a hollow, impermeable, polymeric splash back guard 20 having a truncated apex 22 and an open base 24. The splash back guard 20 has a lip 26 disposed projected edgewise circumferentially bounding the open base 24. A first annular portion 28 is disposed perpendicularly upon the open base 24 and a first angled portion 30 is disposed edgewise circumferentially atop the first annular portion 28. The first angled portion 30 is convergent along a plane extended away from the open base 24.

A second annular portion 32 is disposed perpendicularly edgewise circumferentially atop the first angled portion 30, the second annular portion 32 having a diameter less than the first annular portion 28. A second angled portion 34 is disposed edgewise circumferentially atop the second annular portion 32, said second angled portion 34 disposed convergent along a plane extended away from the open base 24. A third annular portion 36 is disposed perpendicularly edgewise circumferentially atop the second angled portion 34, said third annular portion 36 having a diameter less than the second annular portion 32. The third annular portion 36 is congruent edgewise with the truncated apex 22.

Each of the first, second, and third annular portions 28, 32, 36, may be inset into the open base 24, whereby the splash back guard 20 is collapsible between an extended position, for use, and a compacted position, for storage.

An attachment member 38 is disposed at the truncated apex 22 whereby the truncated apex 22 is securable to a diaper sprayer head 70. The attachment member 38 includes a first ovoid portion 40, a T-shaped connector 42, a second ovoid portion 48, and a tab member 50. The first ovoid portion 40 has a diameter equal to the diameter of the splash back guard 20 at the truncated apex 22, and may be congruent with the truncated apex 22.

The T-shaped connector 42 is disposed laterally projected from one side of the first ovoid portion 40. The T-shaped connector 42 includes a stem member 44, connected perpendicularly to the first ovoid portion 40, and a crossbar 46, disposed transversely endwise upon said stem member 44.

The second ovoid portion 48 is disposed distended laterally from the first ovoid portion 40 on a side of the first ovoid portion 40 opposite to the position of the T-shaped connector 42. The second ovoid portion 48 has a diameter larger than the first ovoid portion 40.

Figure 3:
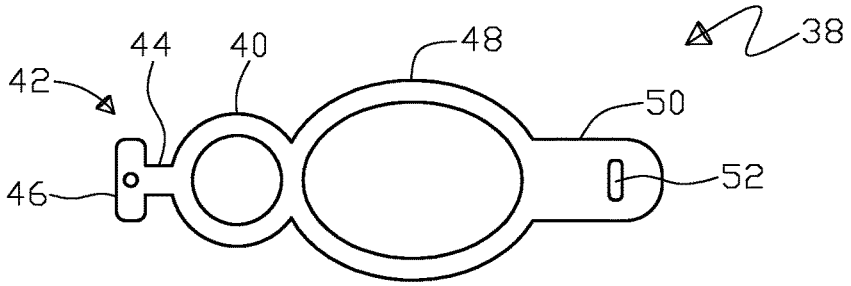
FIG. 3 is an isometric view of an example embodiment of an attachment member.
Figure 4:
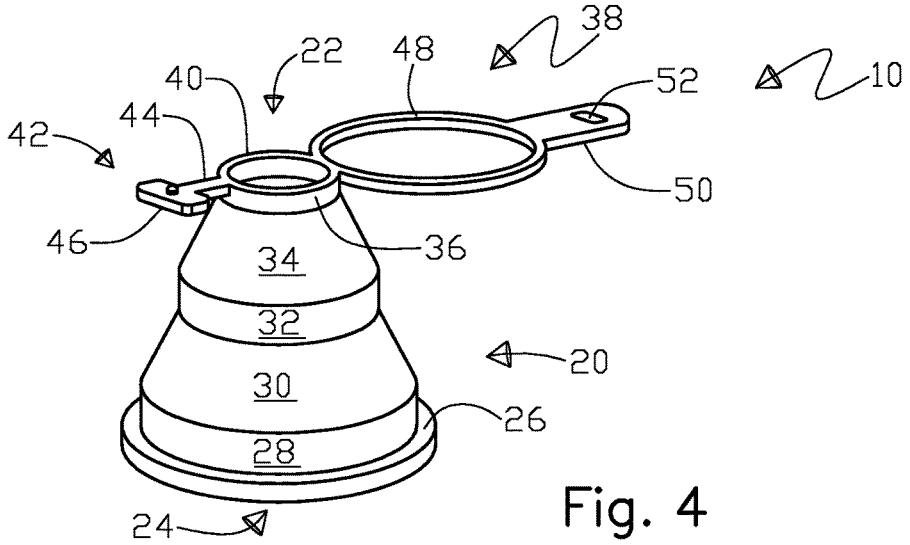
FIG. 4 is an isometric view of an example embodiment.
Figure 5:
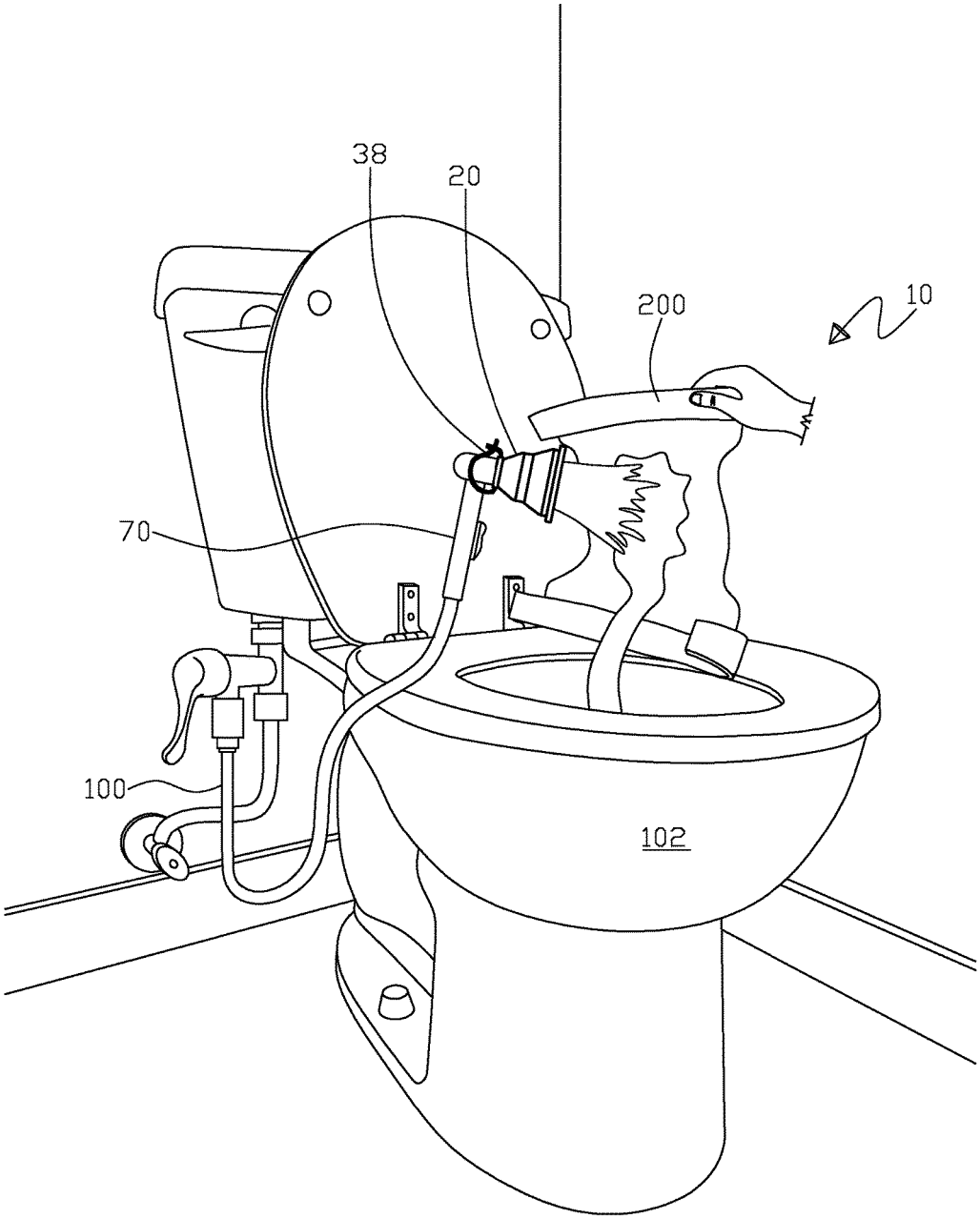
FIG. 5 is an isometric view, in-use, of an example embodiment secured to a diaper sprayer head connected in-line with a toilet waterline.

The tab member 50 is disposed laterally projected from the second ovoid portion 48 in a position opposed to the T-shaped connector 42, whereby the tab member 50 and the T-shaped connector 42 are disposed endwise conjunct a longitudinal axis of the attachment member 38 (see FIG. 3). The tab member 50 includes an elongate aperture 52 disposed therein for releasable engagement with the crossbar 46 of the T-shaped connector 42.

Thus the attachment member 38 is moveable between a released situation, when the crossbar 46 of the T-shaped connector 42 is not inserted and engaged through the elongate aperture 52 of the tab member 50, and an attached situation, when the crossbar 46 of the T-shaped connector 42 is inserted through, and engaged by, the elongate aperture 52 disposed in the tab member 50. When the attachment member 38 is disposed in the attached situation, the second ovoid portion 48 is effectively folded over, and elastically engages against a diaper sprayer head 70 to which the splash back guard 20 is attached and, therefore, the splash back guard 20 is securable to the diaper sprayer head 70 by action of the attachment member 38 rendered in the attached situation.

The splash back guard 20 is thus connectable to a diaper sprayer head 70 disposed connected to a waterline 100 of a toilet 102 and securable thereto, wherein water flow producible by the diaper sprayer head 70 is directable towards a target, such as a soiled diaper for example, and splash back from water forced in contact with said target is thus preventable as contained interior to the splash back guard 20, whereby contamination of proximal surfaces and objects while washing objects, such as soiled diapers, with a diaper sprayer is avoidable.

In an example embodiment herein disclosed, the splash back guard 20 is contemplated to be made of silicone, and thereby impermeable, nontoxic, and thermoset whereby said splash back guard 20 is washable and steamable for sterilization subsequent use, as desired.

In another example embodiment herein disclosed, the splash back guard 20 is contemplated to be made of thermoplastic polyurethane, and thereby impermeable, washable, and readily pliable between the extended position and the compacted position.

What is claimed is:

1. A diaper sprayer flow director and splash back guard adapted for securable connection to a diaper sprayer head, said diaper sprayer flow director and splash back guard comprising a hollow, impermeable, conical splash back guard having a truncated apex and an open base, said splash back guard fittable to a diaper sprayer head and securable thereat conjunct the truncated apex when engaged by an elastomeric attachment member disposed at said truncated apex for securement around said diaper sprayer head, wherein the splash back guard is connectable to a diaper sprayer head disposed connected to a waterline of a toilet, said splash back guard securable thereto to direct water flow towards a target and splash back from water forced in contact with said target is containable, whereby contamination of proximal surfaces and objects while washing diapers with a diaper sprayer is avoidable.

2. The diaper sprayer flow director and splash back guard of claim 1 wherein the attachment member comprises:

a first ovoid portion, said first ovoid portion having a diameter equal to the diameter of the splash back guard at the truncated apex;

a T-shaped connector disposed laterally projected from one side of the first ovoid portion, said T-shaped connector having a stem member connected perpendicularly to the first ovoid portion and a crossbar disposed transversely endwise upon said stem member;

a second ovoid portion disposed distended laterally from the first ovoid portion on a side of the first ovoid portion opposite the position of the T-shaped connector, said second ovoid portion having a diameter larger than the first ovoid portion; and a tab member disposed laterally projected from the second ovoid portion in a position opposed to the T-shaped connector, said tab member including an elongate aperture disposed therein for releasable engagement with the crossbar of the T-shaped connector.

3. The diaper sprayer flow director and splash back guard of claim 2 wherein the splash back guard further comprises:

a lip disposed projected edgewise circumferentially bounding the open base;

a first annular portion disposed perpendicularly upon the open base;

a first angled portion disposed edgewise circumferentially atop the first annular portion, said first angled portion convergent along a plane extended away from the open base;

a second annular portion disposed perpendicularly edgewise circumferentially atop the first angled portion, said second annular potion having a diameter less than the first annular portion;

a second angled portion disposed edgewise circumferentially atop the second annular portion, said second angled portion disposed convergent along a plane extended away from the open base; and a third annular portion disposed perpendicularly edgewise circumferentially atop the second angled portion, said third annular portion having a diameter less than the second annular portion, said third annular portion congruent edgewise with the truncated apex;

wherein the open base has a diameter greater than the diameter of the second annular portion and the diameter of the third annular portion.

4. The diaper sprayer flow director and splash back guard of claim 3 wherein the splash back guard is collapsible, the first, second, and third annular portions positional inset within the circumference of the open base, said splash back guard thereby moveable between a compacted position for storage, and an extended position for use.

5. The diaper sprayer flow director and splash back guard of claim 4 wherein the splash back guard is made of silicone.

6. The diaper sprayer flow director and splash back guard of claim 4 wherein the splash back guard is made of thermoplastic polyurethane.

7. A diaper sprayer flow director and splash back guard disposed for securable connection to a diaper sprayer head, said diaper sprayer flow director and splash back guard comprising:

a hollow, impermeable, conical splash back guard, said splash back guard having a truncated apex and an open base;

an attachment member disposed at the truncated apex, said attachment member comprising:

a first ovoid portion, said first ovoid portion having a diameter equal to the diameter of the splash back guard at the truncated apex;

a T-shaped connector disposed laterally projected from one side of the first ovoid portion, said T-shaped connector having a stem member connected perpendicularly to the first ovoid portion and a crossbar disposed transversely endwise upon said stem member;

a second ovoid portion disposed distended laterally from the first ovoid portion on a side of the first ovoid portion opposite the position of the T-shaped connector, said second ovoid portion having a diameter larger than the first ovoid portion; and a tab member disposed laterally projected from the second ovoid portion in a position opposed to the T-shaped connector, said tab member including an elongate aperture disposed therein for releasable engagement with the crossbar of the T-shaped connector;

wherein the splash back guard is connectable to a diaper sprayer head disposed connected to a waterline of a toilet, said splash back guard securable thereto to direct water flow towards a target and splash back from water forced in contact with said target is containable, whereby contamination of proximal surfaces and objects while washing diapers with a diaper sprayer is avoidable.

8. The diaper sprayer flow director and splash back guard of claim 7 wherein the splash back guard further comprises:

a lip disposed projected edgewise circumferentially bounding the open base;

a first annular portion disposed perpendicularly upon the open base;

a first angled portion disposed edgewise circumferentially atop the first annular portion, said first angled portion convergent along a plane extended away from the open base;

a second annular portion disposed perpendicularly edgewise circumferentially atop the first angled portion, said second annular potion having a diameter less than the first annular portion;

a second angled portion disposed edgewise circumferentially atop the second annular portion, said second angled portion disposed convergent along a plane extended away from the open base; and a third annular portion disposed perpendicularly edgewise circumferentially atop the second angled portion, said third annular portion having a diameter less than the second annular portion, said third annular portion congruent edgewise with the truncated apex;

wherein the open base has a diameter greater than the diameter of the second annular portion and the diameter of the third annular portion.

9. The diaper sprayer flow director and splash back guard of claim 8 wherein the splash back guard is collapsible, the first, second, and third annular portions positional inset within the circumference of the open base, said splash back guard thereby moveable between a compacted position for storage, and an extended position for use.

10. The diaper sprayer flow director and splash back guard of claim 9 wherein the splash back guard is made of silicone.

11. The diaper sprayer flow director and splash back guard of claim 9 wherein the splash back guard is made of thermoplastic polyurethane.

12. A diaper sprayer flow director and splash back guard disposed for securable connection to a diaper sprayer head, said diaper sprayer flow director and splash back guard comprising:

a hollow, impermeable, conical splash back guard, said splash back guard having a truncated apex and an open base, said splash back guard comprising:

a lip disposed projected edgewise circumferentially bounding the open base;

a first annular portion disposed perpendicularly upon the open base;

a first angled portion disposed edgewise circumferentially atop the first annular portion, said first angled portion convergent along a plane extended away from the open base;

a second annular portion disposed perpendicularly edgewise circumferentially atop the first angled portion, said second annular portion having a diameter less than the first annular portion;

a second angled portion disposed edgewise circumferentially atop the second annular portion, said second angled portion disposed convergent along a plane extended away from the open base;

a third annular portion disposed perpendicularly edgewise circumferentially atop the second angled portion, said third annular portion having a diameter less than the second annular portion, said third annular portion congruent edgewise with the truncated apex;

an attachment member disposed at the truncated apex, said attachment member comprising:

a first ovoid portion, said first ovoid portion having a diameter equal to the diameter of the splash back guard at the truncated apex;

a T-shaped connector disposed laterally projected from one side of the first ovoid portion, said T-shaped connector having a stem member connected perpendicularly to the first ovoid portion and a crossbar disposed transversely endwise upon said stem member;

a second ovoid portion disposed distended laterally from the first ovoid portion on a side of the first ovoid portion opposite the position of the T-shaped connector, said second ovoid portion having a diameter larger than the first ovoid portion; and a tab member disposed laterally projected from the second ovoid portion in a position opposed to the T-shaped connector, said tab member including an elongate aperture disposed therein for releasable engagement with the crossbar of the T-shaped connector;

wherein the splash back guard is connectable to a diaper sprayer head disposed connected to a waterline of a toilet, said splash back guard securable thereto to direct water flow towards a target and splash back from water forced in contact with said target is containable, whereby contamination of proximal surfaces and objects while washing diapers with a diaper sprayer is avoidable.

13. The diaper sprayer flow director and splash back guard of claim 12 wherein the splash back guard is collapsible, the first, second, and third annular portions positional inset within the circumference of the open base.

14. The diaper sprayer flow director and splash back guard of claim 13 wherein the splash back guard is made of silicone.

15. The diaper sprayer flow director and splash back guard of claim 13 wherein the splash back guard is made of thermoplastic polyurethane.

* * * * *